United States Patent [19]

Paton et al.

[11] 4,020,893

[45] May 3, 1977

[54] PLANT FOR ELECTROSLAG MELTING OF HOLLOW INGOTS SHAPED AS NON-CLOSED CYLINDERS

[76] Inventors: Boris Evgenievich Paton, ulitsa Kotsjubinskogo, 9, kv. 21; Boris Izrailevich Medovar, ulitsa A. Barbjusa 22/26. kv. 109; Ilya Iosifovich Kumysh, Vozdukhoflotsky prospekt, 42, kv. 51; Georgy Alexandrovich Boiko, ulitsa Vladimiro-Lybedskaya, 16, kv. 106; Alexandr Petrovich Beloglazov, prospekt Voroshilova, 17a, kv. 16; Rudolf Solomonovich Dubinsky, ulitsa Politekhnicheskaya, 5, kv. 209; Valery Alexandrovich Prikhodko, bulvar Davydova, 7, kv. 158; Jury Vladislavovich Minasevich, bulvar Lepse, 43, kv. 1, all of Kiev; Valentin Sergeevich Zameshaev, prospekt Kalinina, 21, kv. 412, Moscow; Jury Alexandrovich Nadtochy, ulitsa Lenina, 20, kv. 16; Alexandr Ivanovich Zvyagintsev, ulitsa Mira, 16, kv. 12, both of Tolyatti Kuibyshevskoi oblasti; Anatoly Georgievich Ushakov, ulitsa Tikhomirova, 17, korpus 3, kv. 157, Moscow, all of U.S.S.R.

[22] Filed: Nov. 3, 1975

[21] Appl. No.: 628,425

Related U.S. Application Data

[63] Continuation of Ser. No. 537,381, Dec. 30, 1974, abandoned.

[52] U.S. Cl. ..... 164/252

[51] Int. Cl.[2] ..... B22D 27/02

[58] Field of Search ..... 164/52, 252

[56] References Cited

UNITED STATES PATENTS

| | | | |
|---|---|---|---|
| 3,800,850 | 4/1974 | Paton et al. | 164/250 |
| 3,841,383 | 10/1974 | Ujiie | 164/52 |
| 3,861,448 | 1/1975 | Medovar et al. | 164/52 |

*Primary Examiner*—John E. Roethel

[57] ABSTRACT

In a plant a carrier for withdrawing an ingot is a drum, rotatably mounted about the horizontal axis thereof, adjacent to the side of a mould near its wall shaping the internal surface of the ingot and coaxial with the wall, with a base plate having a dummy bar and an electrode holder being fastened to the drum shell; the electrode holder being electrically insulated from the drum and carrying at least one electrode curvilinear in shape and encompassing a part of the drum and having a clearance therewith to preclude electrical contact between the drum and the electrode; the drum, while turning, serving also as a mechanism for feeding the electrode into the mould melting space.

5 Claims, 6 Drawing Figures

PLANT FOR ELECTROSLAG MELTING OF HOLLOW INGOTS SHAPED AS NON-CLOSED CYLINDERS

This is a continuation of application Ser. No. 537,381 filed Dec. 30, 1974 now abandoned.

BACKGROUND OF THE INVENTION

The present invention relates to plants for the electroslag melting of consumable electrodes and more particularly to a plant for the electroslag melting of hollow ingots shaped as non-closed cylinders which have found favor in producing cement kiln bands, flanges, rims, shells for pressure vessels and other articles.

Known in the art is a plant for the electroslag melting of hollow ingots shaped as non-closed cylinders by feeding consumable electrodes into the melting space of a water-cooled mould and withdrawing therefrom an ingot with the aid of a carrier. A base plate with a dummy bar is fixed on the carrier.

In the above plant, the ingot-shaped side walls of the mould are radially congruent with an ingot being melted. The mould has a rectangular cross section and is fixed on the base plate.

The carrier for withdrawing an ingot is mounted on the side of one of the mould end faces in the vicinity of the mould. The carrier is made as a driving flat wheel on which an outboard base plate with a dummy bar is secured at right angles to the driving wheel plane. The base plate closes the mould melting space from below at the initial moment.

Immersed in the mould melting space are electrodes, in the form of rectilinear rods whose top ends are fixed in electrode holders. To secure the electrode holders and to feed the consumable electrodes into the mould, the plant is furnished with individual devices.

As the consumable electrodes are being melted, they are lowered into the melting space of the mould and a hollow cylindrical ingot is withdrawn from below due to the rotation of the carrier with the base plate and the dummy bar about its horizontal axis.

When melting hollow ingots shaped as non-closed cylinders in the known plant, due to an outboard attachment of the base plate with the dummy bar on a wheel-shaped carrier, the end of the base plate is liable to displace vertically in the course of withdrawal of the ingot.

With ingots of large lengths, this can cause the skewing and jamming of the ingot in the mould and the effluence of slag and metal therefrom, the ensuing discontinuation of the melting process and the production of low-quality ingots. Therefore, in our opinion, the length of ingots being melted should be limited and should not exceed 300 – 500 mm depending on their thickness.

Moreover, the production of ingots of a strictly cylindrical shape poses a problem since, as a result of deformation brought about by bending moment, the ingots are shaped into a spiral.

The use in the above-described plant of consumable electrodes in the form of rectilinear rods necessitating the use of additional means for their securing and feeding into the mold melting space complicates the plant, makes it cumbersome and metal-consuming (particularly when melting ingots of larger diameters), with a corresponding increase in the cost of the entire plant.

SUMMARY OF THE INVENTION

It is an object of the present invention to provide a plant for electroslag melting of hollow ingots shaped as non-closed cylinders, which makes it possible to obtain high quality ingots of practically any length.

Another object of the invention is to provide a plant for the electroslag melting of hollow ingots shaped as non-closed cylinders ensuring a reliable melting process, eliminating the jamming of the ingot during its withdrawal from a mould and the effluence of slag and metal therefrom, with the ensuing discontinuation of the melting process.

Still another object of the invention is to provide a plant for the electroslag melting of hollow ingots shaped as non-closed cylinders featuring a simple design, small overall dimensions and low metal consumption.

A further object of the present invention is to provide a plant for the electroslag melting of hollow ingots shaped as non-closed cylinders featuring high quality external surface which requires little additional machining.

Yet another object of the invention is to provide a plant for the electroslag melting of hollow ingots shaped as non-closed cylinders with an external surface in the form of a toothed rim.

These and other objects of the present invention are accomplished by the provision of a plant for the electroslag melting of hollow ingots shaped as non-closed cylinders, comprising a water-cooled mould fixed on a frame with mould walls shaping an internal and external surface of the ingot being radially congruent with an ingot being melted, an electrode holder connected to a power supply source, a mechanism for feeding electrodes into a mould melting space and a carrier for withdrawing an ingot, the carrier mounting a base plate with a dummy bar, the base plate being also coupled to the power supply source, wherein, according to the present invention, the carrier for withdrawing an ingot is a drum mounted pivotally about the horizontal axis thereof adjacent to the mould on the side of its wall shaping an internal ingot surface, and coaxially with the wall, the base plate with the dummy bar and the electrode holder being fastened to the drum shell, the electrode holder being electrically insulated from the drum and carrying at least one electrode curvilinear in shape, encompassing a portion of the drum and having a clearance therewith to preclude electric current between the drum and the electrode with the drum while turning, the drum serving also as the mechanism for feeding the electrode into the mould melting space.

In the herein-proposed plant the drum shell may carry spring-biased rests rotatably mounted in the plane of rotation of the drum and securing both the electrode and the ingot with respect to the pivotal axis of the drum.

In one of the exemplary embodiments of the herein-proposed plant, when ingots being melted should meet more stringent requirments as to the quality of their external surface, the fraction of the drum external surface bounded by the base plate with the dummy bar and the electrode holder may act as a mould wall shaping the internal ingot surface. The drum, in this case, is cooled from within.

In case the above plant is employed for melting ingots whose perimeter exceeds their half-circumference, on the external surface of the adjacent to the electrode holder in the direction of motion of the drum, provision is made for a flat section sufficient for removing finished ingots from the drum after the latter has turned.

When melting ingots in the form of a toothed rim, the mould wall shaping the external surface of the ingot is provided with teeth and is mounted with its end faces on the electrode holder and the base plate with the dummy bar, rotatable together with the drum and movable along its axis.

To provide free removal of the finished ingots from the drum, the mould is capable of displacing horizontally.

Thus, the essence of the present invention consists in the following.

Since the carrier is a drum mounted pivotally about the horizontal axis thereof longitudinal, adjacent to the mould on the side of its wall shaping an internal ingot surface, and coaxial with the wall, the attachment of the base plate with the dummy bar on the drum shell prevents the drum from being displaced vertically. The skewing of the ingots, the effluence of slag and metal from the mould and the jamming of the ingot can thereby be avoided. All of the aforesaid makes the melting process stable, reliable and ensures the production of ingots of practically any length.

In the herein-proposed plant, use is made of cast curvilinear electrodes or of curved rods or sheets.

Electrode dimensions and shape should be selected to provide a total cross section of the electrodes which ensure an equality in the volume of metal fed into a slag bath and that of the ingot withdrawn from the mould. This can be accomplished when the supply of the electrodes into the slag bath and the withdrawal of the finished ingot from the mould are effected by means of one and the same drum.

Due to a curvilinear shape of the electrode encompassing the part of the drum and to the mode of attachment of the electrodes on the drum shell, the drum acts also as a mechanism for feeding the electrodes into the mould melting space which obviates the use of additional devices for securing the electrode holders and feeding the electrodes into the mould. This allowed simplifying the design of the plant and offered a decrease in its overall dimensions due to a lower height and smaller area. It also provides a lower metal consumption.

The provision of the spring-biased rests rotatably mounted on the drum shell in the drum turning plane and securing the electrode and the ingot with respect to the drum pivotal axis precludes the origination of a large bending moment acting otherwise on the ingot being withdrawn from the mould. Due to this, the ingot obtained has a regular cylindrical shape.

For melting ingots with an external surface meeting more stringent requirements, it is expedient that a plant be used wherein the part of the external drum surface bounded between the base plate with the dummy bar and the electrode holder acts as a mould wall shaping the internal surface of the ingot.

This can be attributed to the fact that in such a plant, the relative displacement of the internal ingot surface and the ingot-shaping mould wall, which as a rule is related to the occurrence of different surface defects (beadings, tears, etc.), is completely ruled out.

Therefore, the internal surface of the ingot being melted is smooth, has no defects, and requires little additional machining.

In another embodiment of the plant, when the mould wall shaping the external surface of the ingot is mounted with its end faces on the electrode holder and on the base plate with the dummy bar and is rotatable together with the drum when the latter is being turned, the relative displacement of the ingot and the mould is also precluded, and by providing the wall with teeth or imparting to it any other profile, an ingot with an external surface of an intricate outline is obtained. Since the mould wall shaping the external surface of the ingot is movable along the drum axis, the wall can be removed from the mould to withdraw the finished ingot.

Horizontal displacement of this mould is necessary to set the ingot, which after melting, has occupied an "under the drum" position to an "above the drum" position and to remove it from the plant.

BRIEF DESCRIPTION OF THE DRAWINGS

The nature of the invention will be clear from the following detailed description of a particular embodiment thereof, to be considered in conjunction with the accompanying drawings, in which.

DETAILED DESCRIPTION OF PREFERRED EMBODIMENTS

Figure 1:
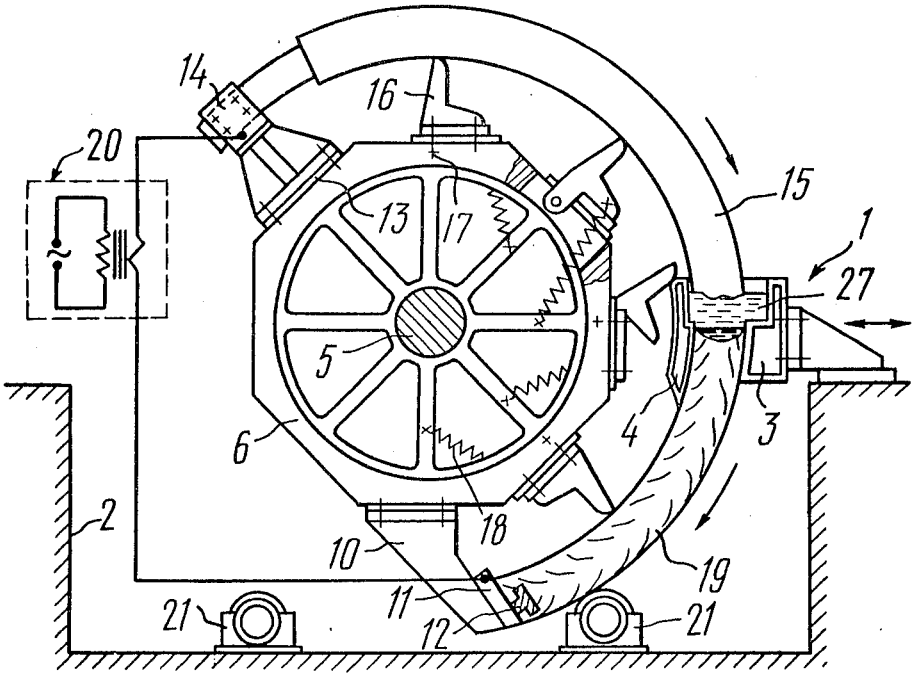
FIG. 1 shows a plant for melting ingots, for producing cement kiln bands, a view on the side of the end face of the drum with a fragmentary cutaway.
Figure 2:
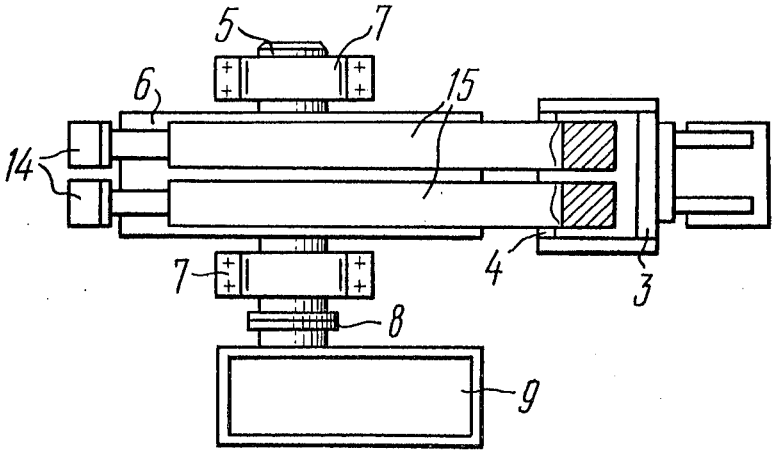
FIG. 2 is a top view of the plant shown in FIG. 1.
Figure 3:
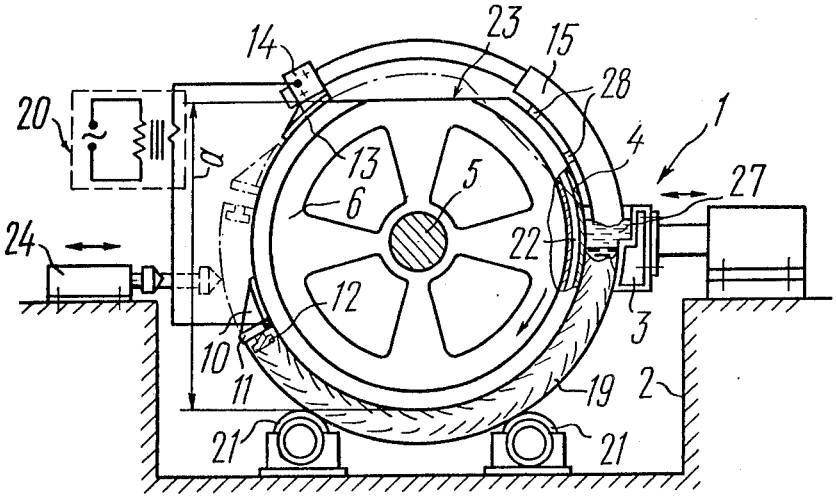
FIG. 3 is another version of a plant, a view from the end face of the drum in the course of melting an ingot.
Figure 4:
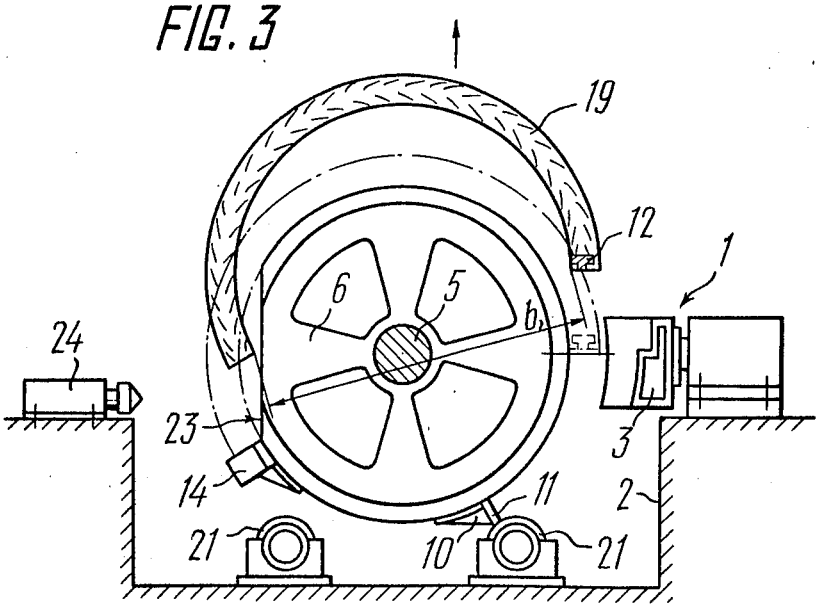
FIG. 4 shows the same plant of FIG. 3 at the moment the finished ingot is being removed.
Figure 5:
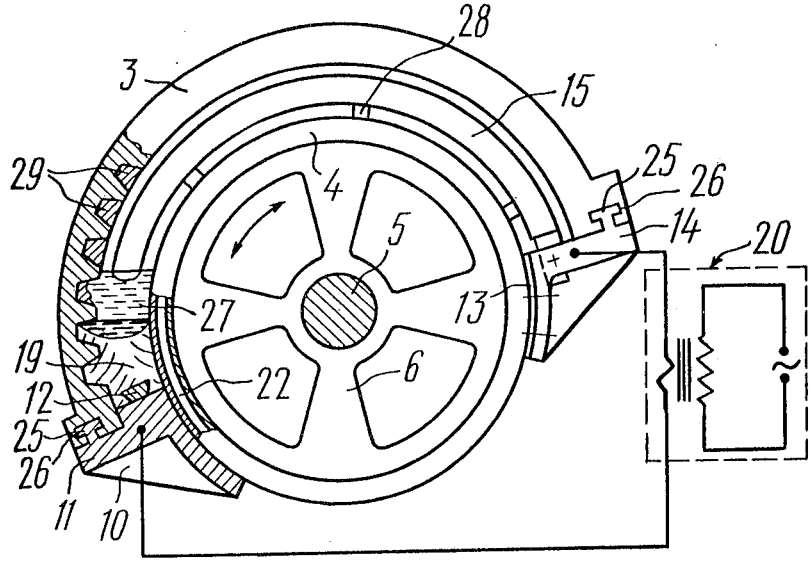
FIG. 5 shows a plant for melting ingots in the form of toothed rims, a view from the drum end face with a fragmentary cutaway.
Figure 6:
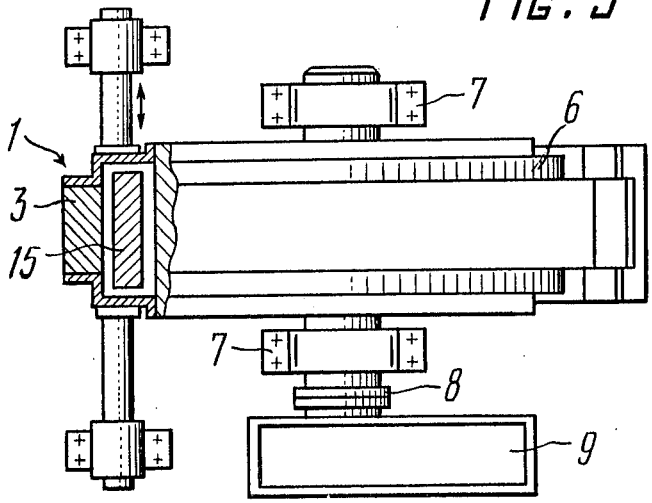
FIG. 6 is a top view of the plant shown in FIG. 5.

Referring now to the drawings the plant comprises a water-cooled mould 1 (FIGS. 1 through 6) fixed on a frame 2 (FIGS. 1, 3 and 4) and capable of being displaced horizontally. Mould walls 3 and 4 adapted to shape the external and the internal surfaces of the ingot are radially congruent with an ingot being melted.

Mounted close to the mold 1 on the side of its wall 4 shaping the internal surface of the ingot, and coaxially with the wall is a drum 6 fitted on a shaft 5 and having a horizontal longitudinal axis.

The drum 6 is rotatably mounted about its longitudinal axis.

When mounting the drum, its axis can deflect from a horizontal line through an angle not exceeding 10°.

The shaft 5 rests on stays 7 (FIGS. 2 and 6) and is connected through a coupling 8 to a drive 9 adapted to rotate the drum 6.

Fixed on the shell of the drum 6, with the aid of a bracket 10 (FIG. 1), is a base plate 11 with a dummy bar 12. Spaced from the base plate at a distance approximating the electrode length is an electrode holder 14 mounted on gaskets 13 insulated electrically and adapted to secure a consumable electrode 15 of a curvilinear shape encompassing the drum portion between the electrode holder and the mould 1.

Secured to the shell of the drum 6 are rests 16 rotatable in the plane of rotation of the drum 6 about axes 17 and pressed against the shell of the drum 6 by means of springs 18.

The rests 16 are adapted to fix the consumable electrode 15 and an ingot 19 being melted with respect to the pivotal axis of the drum 6, i.e. on one side they support the electrode 15 and on the other side the rests 16, upon coming in contact with the internal surface of the ingot 19, prevent its deformation and provide the production of a cylinder-shaped ingot.

Both the electrode holder 14 and the base plate 11 are connected to a power supply source 20.

To support the ingot being melted from below and to recieve the mould 1 and the base plate 11 from the effect of its weight, the frame 2 accommodates spring-biased support rollers 21 disposed under the drum 6 and in contact with the external surface of the ingot 19 being melted.

In another embodiment of the plant, according to the present invention, accomplished substantially similarly to the above-described plant, the part of the external surface of the drum 6 (FIG. 3) bounded between the electrode holder 14 and the base plate 11 acts as the wall 4 of the mould 1 shaping the internal surface of the ingot 19. In this case, the drum body is provided with passages 22 for supplying a coolant (water).

Moreover, in the vicinity of the electrode holder 14, in the direction of motion of the drum 6 during the melting process, the drum 6 is fitted with a flat section 23 ensuring the removal of the finished ingot 19 from the drum 6. The size of the flat section 23 is selected so that the distance *a* from the flat surface to the opposite surface of the drum 6 would be less than the distance *b* (FIG. 4) ($a < b$) between the ends of the ingot 19 being melted.

On the opposite side of the mould 1 near the drum 6, a movable locator 24 is fixed on the frame 2, the locator 24 keeping the ingot from turning as it is being removed from the drum 6.

For melting ingots in the form of toothed rims, the wall 3 of the mould 1 shaping the external surface of the ingot 19 (FIG. 5) is provided with teeth and mounted with its end faces on the electrode holder 14 and the base plate 11.

To this end, the base plate 11 and the electrode holder 14 are fitted with T-shaped slide ribs 25 and the wall end faces with T-shaped recesses 26 whereby the mould wall is able to move together with the drum 6 or along its axis when the plant is being adjusted or when an ingot is being removed therefrom.

To provide more convenient removal of finished ingots, the mould walls shaping ingot end faces are mounted on the frame 2 movably in parallel with the axis of the drum 6.

The herein-proposed plant operates in the following manner.

A case of melting ingots for cement kiln bands is considered hereinbelow. At first the drum 6 (FIG. 1) is placed in a position wherein the base plate 11, with the dummy bar 12 fastened thereto, closes the melting space of the mould 1 from below.

Two consumable electrodes 15, of a rectangular cross section made in the form of half-rings, are placed by means of a crane on rests 16 of the drum 6 so that one end of each electrode is introduced into the electrode holder 14 while the other end of each electrode is placed at a certain distance from the base plate 11, depending on the electrode thickness. On being set in place, the electrodes 15 are secured in the electrode holder 14.

Next slag is poured into the mould from a ladle so that the ends of the electrodes 15 are immersed into the slag, and an operating voltage is applied to the consumable electrodes 15.

Due to the heat liberated by a slag bath 27, the ends of the electrodes commence to fuse and droplets of metal melt off the tips of the electrodes and collect in a metal pool on the base plate 11, the metal pool merging and setting with the dummy bar 12 to form an ingot 19.

After an electric current of a requisite magnitude has been obtained, the drum 6 is turned at a rate ensuring the required remelting current.

As the drum 6 turns to the mould, the consumable electrodes 15 are lowered from above into the slag bath 27 and the ingot is withdrawn from the mould from below. The withdrawal of the ingot is assisted by the drum 6 which acts in this case as a carrier.

The drum is turned until an ingot of a requisite size is produced. After that, the drum 6 is stopped and the electrode holder with the base plate are de-energized.

Next, stubs are removed and the drum 6 is turned further to ensure the emergence of the end of the ingot 19 from the mould 1.

Following that, the mould 1 is shifted in a horizontal plane aside from the drum 6, i.e. it is removed from the ingot-melting zone, and by turning the drum in a direction opposite to the initial one, the finished ingot is placed in an "above the drum" position.

Next, the dummy bar 12 is disengaged from the base plate 11 and the ingot 19 is removed from the drum 6.

Considered hereinbelow is the functioning of another embodiment of the proposed plant.

When melting ingots whose external surfaces should meet more stringent requirements, use is made of a plant in which the portion of the external surface of the drum serves as a mould wall.

In this plant the consumable electrodes 15 (FIG. 3) are placed on the drum with the help of temporary electricallyinsulating gaskets 28 produced, for example, from solid slag. The insulating gaskets 28 are melted in the slag bath 27 concurrently with the consumable electrodes.

In other respects, the operation of the above plant is similar to the first described plant.

When melting ingots whose perimeter exceeds their half-circumference, the ingot is removed from the drum in the following manner.

On removal of the stubs of the consumable electrodes 15, the dummy bar 12 is disengaged from the base plate and the locator 24 thrusts against the ingot to preclude its rotation. Next, the mould is shifted from the melting zone and crystallized slag is removed therefrom. The drum 6 is turned until the electrode holder 14 strikes against the ingot 19. Following that, the locator 24 is carried off from the ingot surface and the drum 6 is turned until its flat section 23 is placed vertically. Then the ingot 19 is freely removed from the drum 6.

A case of a plant for melting ingots in the form of toothed rims is considered below.

To set up the electrode 15 on the drum 6 of such a plant, the outside wall 3 is shifted relative to the drum shell due to the provision of the T-shaped recesses and slide ribs accordingly in the base plate, electrode holders and wall ends. The electrodes 15 are placed on electrically insulating gaskets 28.

Following that, the wall 3 is placed in a working position whereupon the melting process is effected similarly to that described above.

To provide for the formation of teeth on the external surface of the ingot, prefabricated elements 29 in the form of rim teeth, are placed in the recesses provided in the internal surface of the wall 3 and secured thereto before the melting process has been initiated. As the target is being melted, the elements 29 fuse together (merge) with the ingot body forming an ingot in the form of a toothed rim.

Upon melting the toothed rim, the end face walls are shifted aside and the drum is turned so that the toothed rim is set to an "above the drum" position. Next, the toothed wall 3 of the mould 1 is displaced along the drum axis and the finished toothed rim is removed from the plant.

As it is clear from the description, there is proposed a plant which, owing to its inherent design distinguished by a relative simplicity, small overall dimensions and low metal consumption, ensures a reliable withdrawal of ingots from the mould and the production of ingots of a requisite geometry and practically any length depending on the drum length.

What we claim is:

1. A plant for the electroslag melting of ingots shaped as non-closed cylinders, comprising: a frame; a water-cooled mould fixed on the frame with mould walls shaping an internal and external surface of the ingot being radially congruent with an ingot being melted; a drum rotatably mounted about the horizontal longitudinal axis thereof, the drum being mounted adjacent to the mould on the side of the wall shaping the internal surface of the ingot and coaxial with the wall; a base plate with a dummy bar fastened to the drum shell, the base plate being coupled to a power supply source; an electrode holder secured to the drum shell, the electrode holder being electrically insulated from the drum and coupled to the power supply source; at least one electrode, curvilinear in shape, set up in the electrode holder, encompassing a portion of the drum and having a clearance therewith to preclude electric contact between the drum and electrode; the drum, while turning, serving also as a carrier for withdrawing the ingot and as a device for securing the electrode holder and feeding the electrode into the mould melting space; and spring-biased rests rotatably mounted on the drum shell in the plane of rotation of the drum and securing the electrode and the ingot with respect to the pivotal axis of the drum.

2. The plant as claimed in claim 1, wherein a section of the external surface of the drum, bounded between the base plate with the dummy bar and the electrode holder, acts as a mould wall shaping the internal surface of the ingot, the drum being water-cooled from the inside.

3. The plant as claimed in claim 2, wherein adjacent to the electrode holder, in the direction of rotation of the drum, the drum has a flat section on its external surface, the flat section being sufficient to remove the finsihed ingots from the drum after the drum has turned.

4. The plant as claimed in claim 2, wherein the mould wall shaping the external surface of the ingot is made toothed and its end faces are mounted on the electrode holder and the base plate with the dummy bar, the mould wall rotatable together with the drum and movable along the drum axis.

5. The plant as claimed in claim 1, wherein the mould is movably mounted on the frame in a horizontal direction to provide for the removal of the finished ingot.

* * * * *